US007618276B2

(12) United States Patent
Paglia et al.

(10) Patent No.: US 7,618,276 B2
(45) Date of Patent: Nov. 17, 2009

(54) CONNECTOR ASSEMBLY WITH GRIPPING SLEEVE

(75) Inventors: Richard Paglia, Springfield, MA (US); Weixing Chen, Changzhou (CN); Minghua Gu, Changzhou (CN)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 12/003,108

(22) Filed: Dec. 20, 2007

(65) Prior Publication Data

US 2008/0318469 A1 Dec. 25, 2008

Related U.S. Application Data

(60) Provisional application No. 60/929,266, filed on Jun. 20, 2007.

(51) Int. Cl.
*H01R 4/38* (2006.01)

(52) U.S. Cl. ..... 439/322

(58) Field of Classification Search ..... 439/323, 439/322, 320, 578
See application file for complete search history.

(56) References Cited

U.S. PATENT DOCUMENTS

| | | | | |
|---|---|---|---|---|
| 3,323,098 | A | | 5/1967 | Michael et al. |
| 4,116,521 | A | | 9/1978 | Herrmann, Jr. |
| 4,408,821 | A | | 10/1983 | Forney, Jr. |
| 4,452,503 | A | | 6/1984 | Forney, Jr. |
| 4,496,795 | A | | 1/1985 | Konnik |
| 4,660,921 | A | | 4/1987 | Hauver |
| 4,676,577 | A | * | 6/1987 | Szegda ..... 439/584 |
| 4,690,481 | A | | 9/1987 | Randolph |
| 4,854,893 | A | | 8/1989 | Morris |
| 5,002,503 | A | * | 3/1991 | Campbell et al. ..... 439/578 |
| 5,007,861 | A | | 4/1991 | Stirling |
| 5,073,129 | A | | 12/1991 | Szegda |
| 5,141,451 | A | | 8/1992 | Down |
| 5,217,393 | A | | 6/1993 | Del Negro et al. |
| 5,295,864 | A | | 3/1994 | Birch et al. |
| 5,316,348 | A | * | 5/1994 | Franklin ..... 285/39 |
| 5,352,134 | A | | 10/1994 | Jacobsen et al. |
| 5,367,925 | A | * | 11/1994 | Gasparre ..... 81/121.1 |

(Continued)

FOREIGN PATENT DOCUMENTS

JP 2006172918 6/2006

(Continued)

OTHER PUBLICATIONS

International Search Report dated Oct. 29, 2008 in International Application No. PCT/US2008/067727 filed Jun. 20, 2008.

*Primary Examiner*—Neil Abrams
*Assistant Examiner*—Harshad C Patel
(74) *Attorney, Agent, or Firm*—Blank Rome LLP

(57) ABSTRACT

A connector assembly includes an electrical connector and a sleeve. The electrical connector has opposite first and second ends. The first end is rotatable with respect to the second end and configured to couple to a mating connector. The second end is configured to terminate a cable. The sleeve is molded over the first end such that the sleeve is fixed to the first end, and the sleeve and the first end of the connector together rotate with respect to the second end of the connector. Also, the sleeve has an outer gripping surface.

17 Claims, 5 Drawing Sheets

U.S. PATENT DOCUMENTS 5,435,745 A 7/1995 Booth
5,456,614 A 10/1995 Szegda
5,466,173 A 11/1995 Down
5,474,470 A 12/1995 Hammond, Jr.
5,499,934 A 3/1996 Jacobsen et al.
5,548,088 A 8/1996 Gray et al.
5,598,132 A 1/1997 Stabile
5,651,699 A 7/1997 Holliday
5,660,565 A 8/1997 Williams
6,027,373 A 2/2000 Gray et al.
6,034,325 A 3/2000 Nattel et al.
6,331,123 B1 12/2001 Rodrigues
D458,904 S * 6/2002 Montena ..... D13/154
D462,327 S 9/2002 Montena
6,454,462 B2 9/2002 Nguyen et al.
6,530,807 B2 * 3/2003 Rodrigues et al. ..... 439/578
6,712,631 B1 * 3/2004 Youtsey ..... 439/322
6,767,247 B2 7/2004 Rodriquez et al.
6,776,657 B1 8/2004 Hung et al.
6,783,394 B1 * 8/2004 Holliday ..... 439/578
6,790,083 B1 9/2004 Chen et al.
6,808,415 B1 10/2004 Montena
6,817,896 B2 * 11/2004 Derenthal ..... 439/578
6,848,920 B2 * 2/2005 Fox ..... 439/133
6,884,114 B2 * 4/2005 Khemakhem et al. ..... 439/580
6,884,115 B2 4/2005 Malloy
6,887,102 B1 * 5/2005 Burris et al. ..... 439/578
6,908,337 B1 6/2005 Li et al.
6,916,200 B2 * 7/2005 Burris et al. ..... 439/578
6,960,101 B1 11/2005 Chen et al.
6,971,912 B2 12/2005 Montena et al.
7,014,501 B2 3/2006 Montena
7,029,304 B2 4/2006 Montena
7,059,900 B2 6/2006 Holliday
7,097,500 B2 8/2006 Montena
7,128,603 B2 10/2006 Burris et al.
7,144,272 B1 * 12/2006 Burris et al. ..... 439/578
7,163,420 B2 1/2007 Montena
7,189,091 B1 * 3/2007 Montena ..... 439/322
7,192,308 B2 * 3/2007 Rodrigues et al. ..... 439/578
7,226,300 B2 6/2007 Khemakhem
7,281,947 B2 * 10/2007 Pescatore ..... 439/578
7,311,555 B1 12/2007 Burris et al.
7,329,149 B2 2/2008 Montena
7,364,462 B2 4/2008 Holland
7,371,113 B2 * 5/2008 Burris et al. ..... 439/578
2002/0013088 A1 1/2002 Rodrigues et al.

FOREIGN PATENT DOCUMENTS

JP 2007-066663 3/2007

* cited by examiner

CONNECTOR ASSEMBLY WITH GRIPPING SLEEVE

CROSS-REFERENCE TO RELATED APPLICATION

This application claims priority under 35 U.S.C. §119(e) to U.S. Provisional Patent Application No. 60/929,266, entitled "Connector Assembly with Gripping Sleeve" by Richard Paglia et al., filed on Jun. 20, 2007, the entire disclosure of which is incorporated herein by reference. This application may relate to commonly assigned, co-pending U.S. patent application Ser. No. 12/003,109, entitled "Connector Assembly with Gripping Sleeve", filed concurrently herewith.

FIELD OF THE INVENTION

The present invention relates to connector assemblies with a sleeve. In particular, the present invention relates to electrical connector assemblies with an overmolded sleeve to facilitate gripping and mating of the connector to its counterpart connector.

BACKGROUND OF THE INVENTION

Connector assemblies are often used to terminate a cable and adapt the cable for attachment to a device, another connector, or another cable. The connector assembly often includes a body with a rotating nut portion with internal threads. The nut portion rotates with respect to the body so that the internal threads of the nut can engage corresponding threads of the device, the other connector, or the other cable. For proper functioning of the connector assembly, the nut portion must be fully twisted onto the corresponding threads. A loose connection can fail to provide the positive contact needed for continuity between the cable and the device, the other connector, or the other cable. Also, a loose connection can come apart accidentally disrupting the connection to the device, the other connector, or the other cable. A loose connection can also cause signal leakage and degraded performance.

Furthermore, connector assemblies are often assembled under conditions in which the user cannot adequately grasp the nut portion of the connector assembly. Without a sure grip, the user often fails to properly mate the connector assembly with the other device, the other connector, or the other cable. Also, the likelihood of a loose connection occurring increases, making the connector assembly more susceptible to separating from the device, the other connector, or the other cable and may cause signal leakage.

Thus, a need in the art exists for an improved connector assembly that assists in gripping the connector of the connector assembly and mating the connector to its counterpart connector.

SUMMARY OF THE INVENTION

Accordingly, it is an aspect of the invention to provide a connector assembly with a connector and a sleeve to facilitate gripping and mating of the connector to its counterpart connector.

One embodiment of the present invention provides a connector assembly. The connector assembly includes an electrical connector having opposite first and second ends, the first end being rotatable with respect to the second end and configured to couple to a mating connector, the second end being configured to terminate a cable; and a sleeve molded over the first end such that the sleeve is fixed to the first end, the sleeve and the first end of the connector together rotate with respect to the second end of the connector, and the sleeve having an outer gripping surface.

Another embodiment of the present invention provides a connector assembly. The connector assembly includes an electrical connector; and a gripping sleeve disposed on the electrical connector, the gripping sleeve comprising an elongated body having opposite ends and a plurality of lateral surfaces disposed adjacent to each other and meeting at adjacent edges to form a substantially hexagonal shape in cross-section, a spine disposed at the adjacent edges of the lateral surfaces, the spine extending longitudinally along the adjacent edges between the ends of the elongated body, a first face and a second face at the opposite ends of the body, the first and second faces being substantially perpendicular to the lateral surfaces, and a bore extending through the body from the first face to the second face.

Yet another embodiment of the present invention provides a method of forming a connector assembly. The method comprising the steps of: providing an electrical connector having opposite first and second ends, the first end being rotatable with respect to the second end and configured to couple to a mating connector, the second end being configured to terminate a cable; and molding a sleeve over the first end such that the sleeve is fixed to the first end, the sleeve having an outer gripping surface, whereby the sleeve and the first end of the electrical connector together rotate with respect to the second end of the connector.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1-9 the present invention relates to a connector assembly 100 with a sleeve 120 that is fixed to a connector 110. The sleeve 120 provides improved gripping of the connector 110. The sleeve 120 does not come off of the connector assembly 100 for safety reasons.

Figure 1:
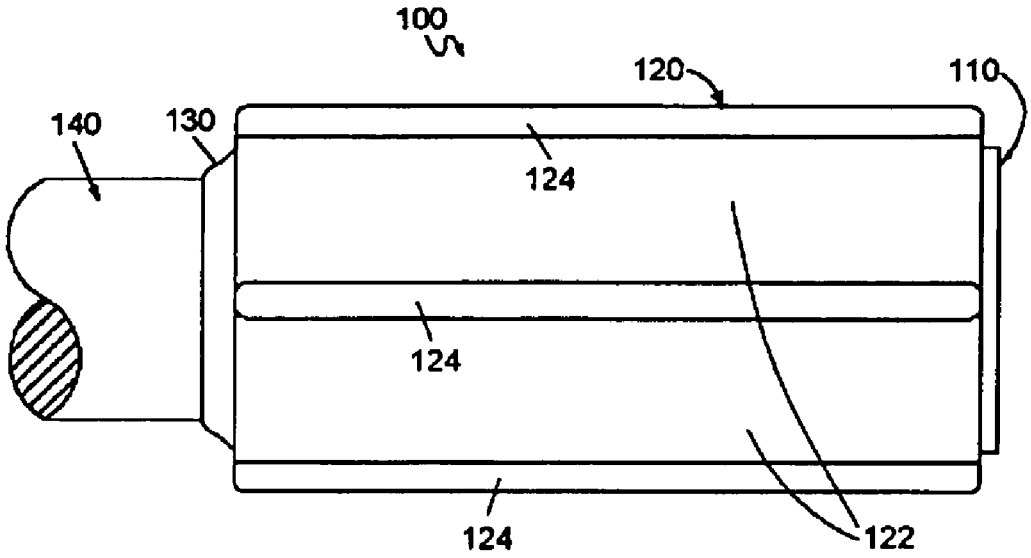
FIG. 1 is a side elevational view of a connector assembly according to an exemplary embodiment of the present invention.

Referring to FIG. 1, the connector assembly 100 includes, at least, the connector 110 and the sleeve 120. The connector assembly 100 may also include a tube 130. If the connector assembly 100 includes the tube 130, then the sleeve 120 is disposed over the tube 130 and the connector 110.

The connector 110 is configured to terminate a cable 140 and adapt the cable 140 for attachment to a device, another connector, or another cable. The connector 110 can be an electrical connector, an optical connector, a fluid connector, a pneumatic connector, a hydraulic connector, or some other type of connector. To simplify and facilitate the description of the invention, the connector 110 will be described as an electrical connector, but the invention is not limited to only embodiments with an electrical connector.

The sleeve 120 facilitates the mating of the connector 110 to its mating device or connector. The sleeve 120 is integrated with a portion of the connector 110. Preferably, the sleeve 120 is molded to one end of the connector 110, as described below. Integrating the sleeve 120 with the connector 110 ensures that the sleeve 120 is not lost or separated from the connector 110. The sleeve 120 can be made of any rubber, synthetic rubber, neoprene, thermoplastic, thermosetting plastic, plastic (such as, but not limited to, polyethylene, polypropylene, polystyrene, acrylonitrile butadiene styrene, polyethylene terephthalate, polyester, polyamides, polyvinyl chloride, polyurethanes, or polycarbonate), combinations of the above, and other similar materials.

The sleeve 120 can be sized to allow a user to achieve high levels of torque when mating the connector 110 with another device or connector without the use of tools. Also, the sleeve 120 can have a gripping surface 122 that aids in grasping the sleeve 120, facilitates the use of tools, or both. The gripping surface 122 can include ridges, grooves, knuris, combinations of the aforementioned, and the like. The gripping surface 122 may also be smooth. Preferably, the sleeve 120 has one or more spines 124. The spines 124 further facilitate gripping the connector assembly 100. The spines 124 preferably extend longitudinally the length of the sleeve 120.

Figure 2:
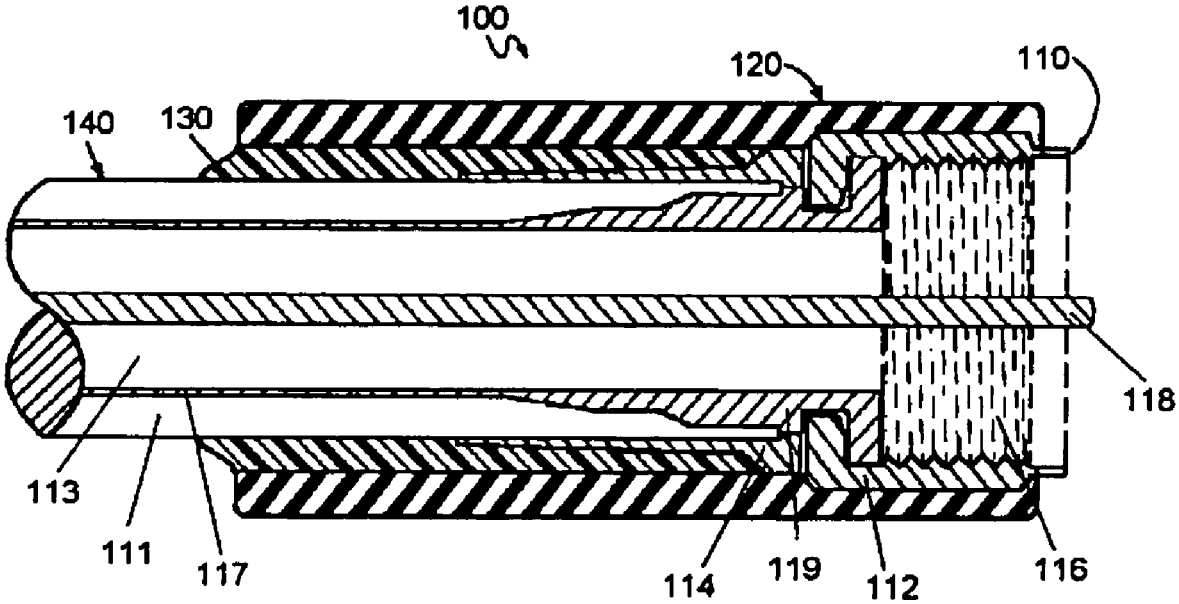
FIG. 2 is a sectional view of the connector assembly illustrated in FIG. 1.

Referring to FIG. 2, the connector 110 connects to a mating device or connector (not shown). The connector 110 has a first end 112 and a second end 114 opposite the first end 112. The first end 112 includes a mating structure 116 that couples the connector 110 to a mating device or connector. The mating structure 116 is preferably threads as shown, but can be any structure configured to mate one device or connector with another, such as a radially extending post adapted to be received in a slot of the mating connector or the slot that receives a post. The first end 112 requires some manipulation, such as twisting, pushing, or pulling, to mate the connector 110 with a mating device or connector. The manipulation can be completed manually or with a tool. When twisting the connector 110, the first end 112 rotates with respect to the second end 114. Alternatively, if the connector 110 requires pushing or pulling, the first end 112 moves longitudinally with respect to the second end 114.

Whether the first end 112 rotates with respect to the second end 114 or moves longitudinally with respect to the second end 114, the sleeve 120 is fixed to the first end 112 of the connector 110 so that the sleeve 120 and the first end 112 rotate or move together with respect to the second end 114 of the connector 110. The second end 114 does not rotate when the sleeve 120 is rotated because the second end 114 is fixed to the cable 140. Preferably, the sleeve 120 is overmolded on the connector 110, thereby fixing the sleeve 120 to the connector 110. In the embodiment depicted in FIG. 2, the sleeve 120 is molded to the first end 112 and the tube 130. The tube 130 is adapted to move independently of the second end 114. Thus, when the sleeve 120 rotates, the first end 112 and the tube 130 both rotate with the sleeve 120, but the second end 114 does not rotate with the first end 112 and the tube 130.

In the exemplary embodiment depicted in FIG. 2, the connector 110 is an F connector for a coaxial cable. As depicted, the F connector has internal threads as its mating structure 116 that engage corresponding threads of its mating device or connector. The first end 112 of the F connector is a nut assembly that rotates with respect to the second end 114 so that the threads can engage corresponding threads of a mating device or connector. Thus, the F connector requires twisting of the first end 112 to couple the connector 110 to its mating device or connector. Accordingly, the sleeve 120 is molded to the first end 112 fixing the sleeve 120 to the first end 112 so that, when the sleeve 120 is rotated, the first end 112 of the connector 110 rotates with respect to the second end 114, and the user can grasp and twist the sleeve 120, thus facilitating the engagement of the threads to a counterpart of the F connector. Although the connector 110 is depicted and described as an F connector to simplify and facilitate the description of the connector assembly 100, the connector 110 can also be a Bayonet Neill-Concelman ("BNC") connector, a Threaded Neill-Concelman ("TNC") connector, a C connector, an N connector, an SMA connector, or other similar electrical connector.

The second end 114 of the connector 110 terminates the cable 140. The second end 114 can terminate the cable 140 such as by crimping, welding, using an adhesive, or other similar methods. In the embodiment depicted in FIG. 2, the cable 140 is terminated by crimping the cable 140 to the second end 114.

The cable 140 provides a pathway for an electrical signal, an optical signal, a fluid, a gas, or some other type of signal or matter. In the embodiment shown in FIG. 2, the cable 140 is an electrical cable, and in particular a coaxial cable. The coaxial cable includes a jacket 111, a conductive sheath 117, a dielectric insulator 113, and a center conductor 118. The jacket 111 provides insulation and can be made of any material with low electrical conductivity, such as polyvinylchloride. Coaxial cables may be rigid or flexible. Rigid coaxial cables have a solid conductive sheath 117, while flexible coaxial cables have a braided sheath 117, usually made of small-diameter copper wire or some other conductive material. In the embodiment shown, the conductive sheath electrically couples to an outer conductor 119 of the F connector. The dielectric insulator 113 insulates the conductive sheath 117 from the center conductor 118 and affects the impedance and attenuation characteristics of the coaxial cable. The dielectric insulator 113 may be solid, as shown, or perforated with air spaces and can be made of any material with poor electrical conductivity, such as polyethylene. As an electrical signal travels along the cable 140, the electrical signal forms an associated magnetic field that extends beyond the cable 140 through the jacket 111 of the cable 140. The magnetic field can distort the electrical signal if the cable 140 is bent near itself or if the cable 140 is routed near another conductive material. However, electrical signals traveling by way of coaxial cables are substantially shielded by the conductive sheath 117 and confined to the center conductor 118. Thus, electrical signal transmission occurs substantially between the conductive sheath 117 and the center conductor 118 through the dielectric insulator 113. Therefore, coaxial cables can be bent and moderately twisted without the electrical signal affecting itself. Also, coaxial cables can be routed relatively closer to other conductive materials without distorting the electrical signal. The coaxial cable can be, but is not limited to, RG-6, CATV distribution coaxial, RG-8, RG-11, RG-58, RG-59, or other similar cables.

Figure 3:
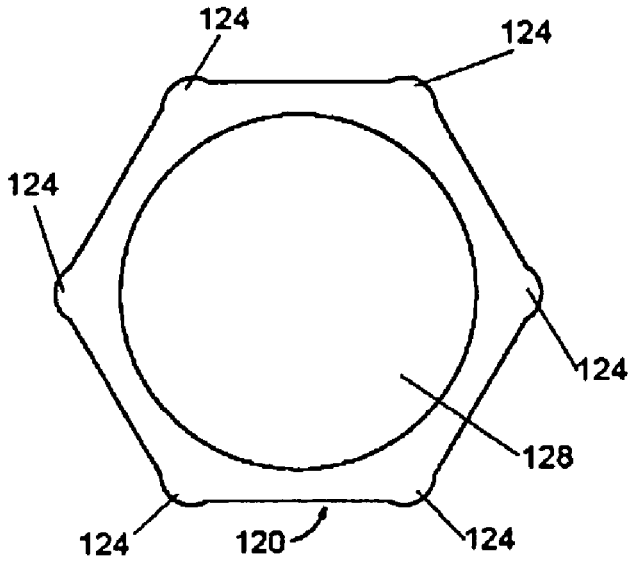
FIG. 3 is a front elevational view of a sleeve of the connector assembly illustrated in FIG. 1.

Referring to FIG. 3, the sleeve 120 is shown without the connector 110. The sleeve 120 in the exemplary embodiment shown has a substantially hexagonal shape in cross-section. The cross-sectional shape of the sleeve 120 can be formed so that conventional tools, such as a wrench adapted to engage hexagonal nut assemblies, may be applied to the sleeve 120 to twist the connector 110. Although a substantially hexagonal shape in cross-section is depicted, the sleeve 120 can have any other shape in cross-section.

Figure 5:
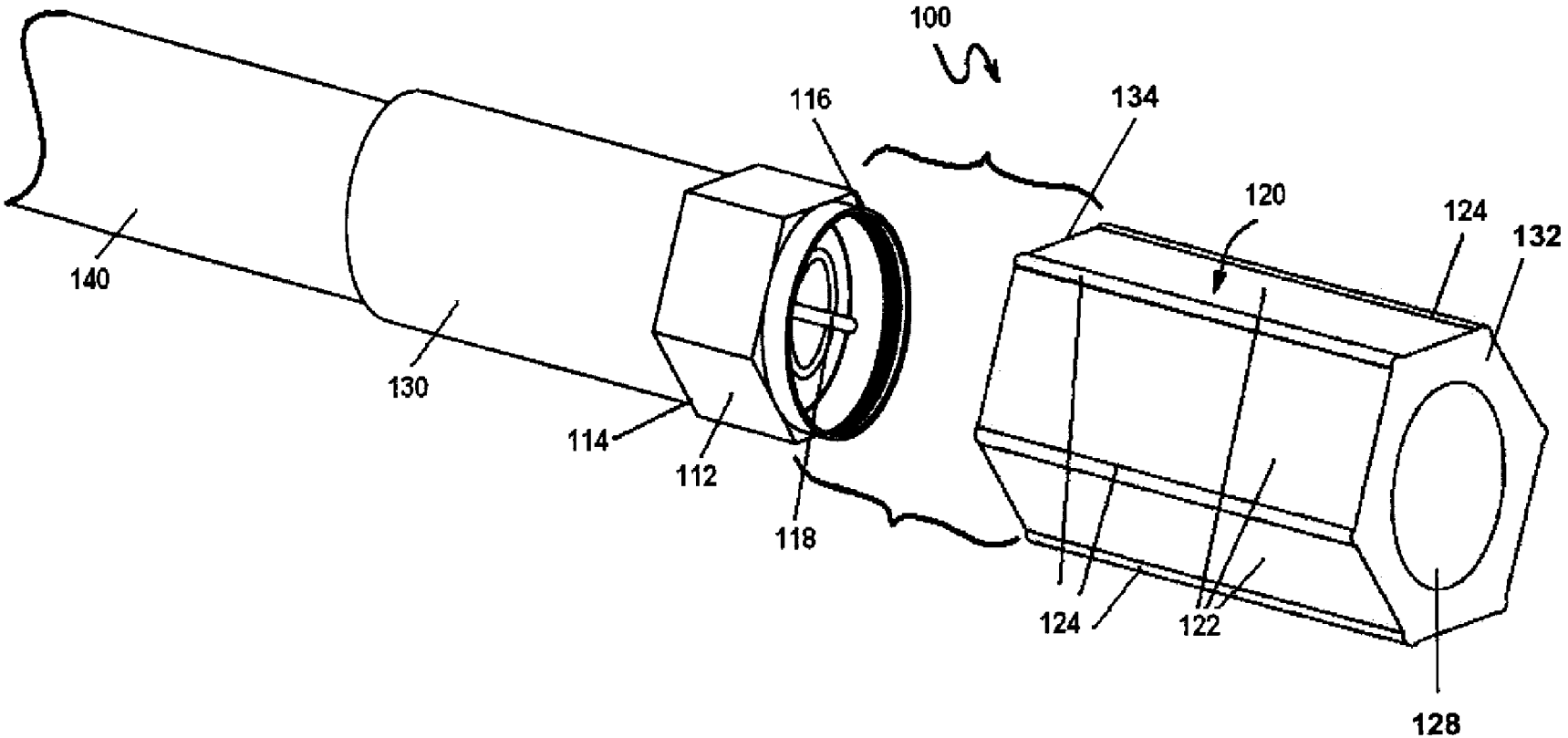
FIG. 5 is an exploded perspective view of the connector assembly illustrated in FIG. 1.

The sleeve 120 also has a bore 128 to receive the connector 110. The cross-sectional shape of the bore 128 may vary along the length of the sleeve 120 so that the bore 128 receives the connector 110 and the tube 130, if provided. As shown in FIG. 5, the sleeve 120 also has a first face 132 and a second face 134, both of which are perpendicular to grinning surfaces 122. The bore 128 extends from the first face 132 to the second face 134.

Figure 4:
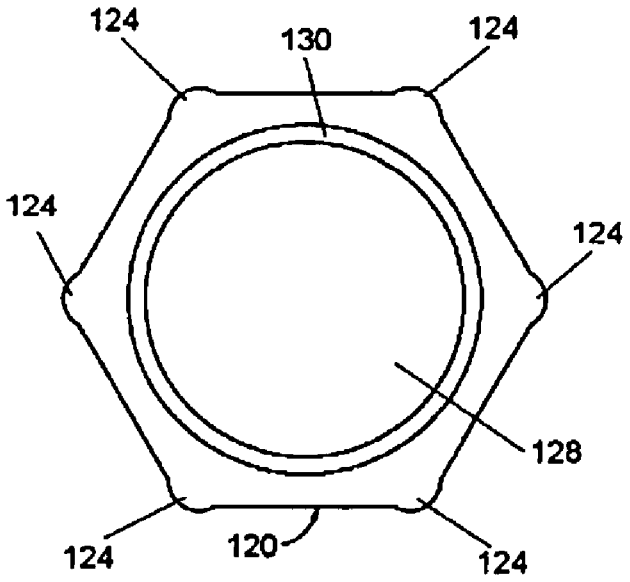
FIG. 4 is a rear elevational view of the sleeve illustrated in FIG. 3.

Referring to FIG. 4, the sleeve 120 is shown without the cable 140. The sleeve 120 in the exemplary embodiment shown has the tube 130 to facilitate overmolding of the sleeve 120 on the connector 110. The tube 130 receives the second end 114 of the connector 110. The tube 130 can also assist in terminating the cable 140 to the connector 110. The tube 130 can be, for example, a compression ring which is often used together with a crimping tool to terminate a coaxial cable to an F connector. The tube 130 also has a shape adapted to surround a portion of the outer surface of the cable 140. The tube 130 may have a substantially circular shape in cross-section with a circular bore 128 as shown to accept the cable 140. The tube 130 is preferably made of high density polyethylene (HDPE) but may be formed from any rigid material, such as other plastics or metal.

Referring to FIG. 5, the substantially hexagonal shape of the sleeve 120 conforms to the first end 112 which is a hexagonal nut assembly. Because the sleeve 120 is integral or fixed with the first end 112 of the connector 110, by gripping and rotating the sleeve 120, the first end 112 of the connector 110 rotates. The user thus may grip the gripping surface 122 of the sleeve 120 instead of the relatively smaller first end 112 when coupling the connector 110 with its mating connector. The overmold sleeve design also provides mechanical support to weak points of the connector assembly 100, such as the interface between the connector 110 and the cable 140. Thus, the cable 140 is less susceptible to damage.

Figure 6:
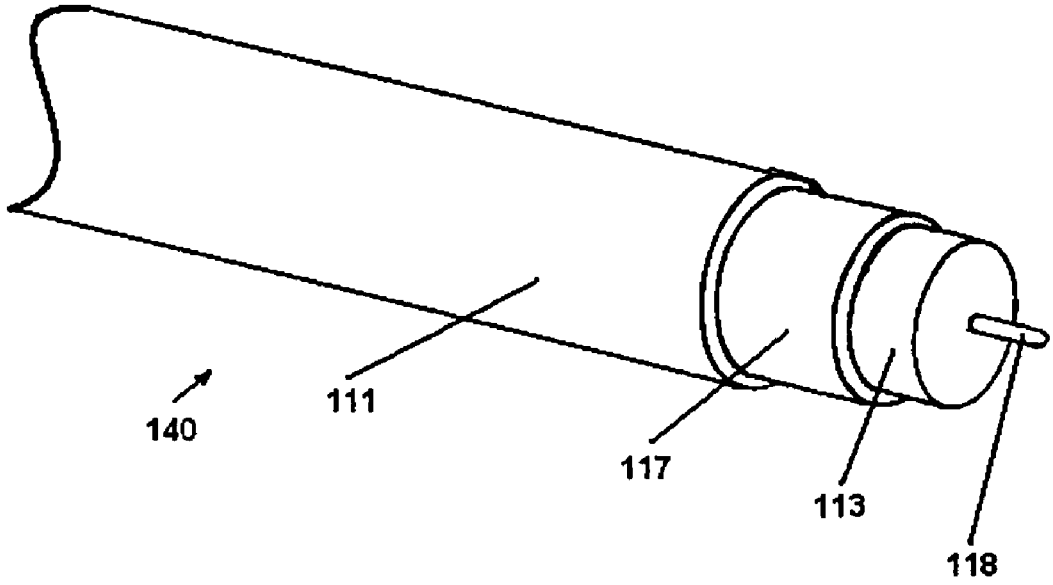
FIG. 6 is a perspective view of a cable of the connector assembly illustrated in FIG. 1.

Referring to FIG. 6, to make the connector assembly 100, the cable 140 is prepared for termination in the second end 114 of the connector 110. For a coaxial cable, a portion of the jacket 111, the conductive sheath 117, and the dielectric insulator 113 are removed to expose the center conductor 118. Then, a portion of the jacket is stripped to expose the conductive sheath 117 underneath. Next, the conductive sheath 117 is peeled back to expose a portion of the dielectric insulator 113.

Figure 7:
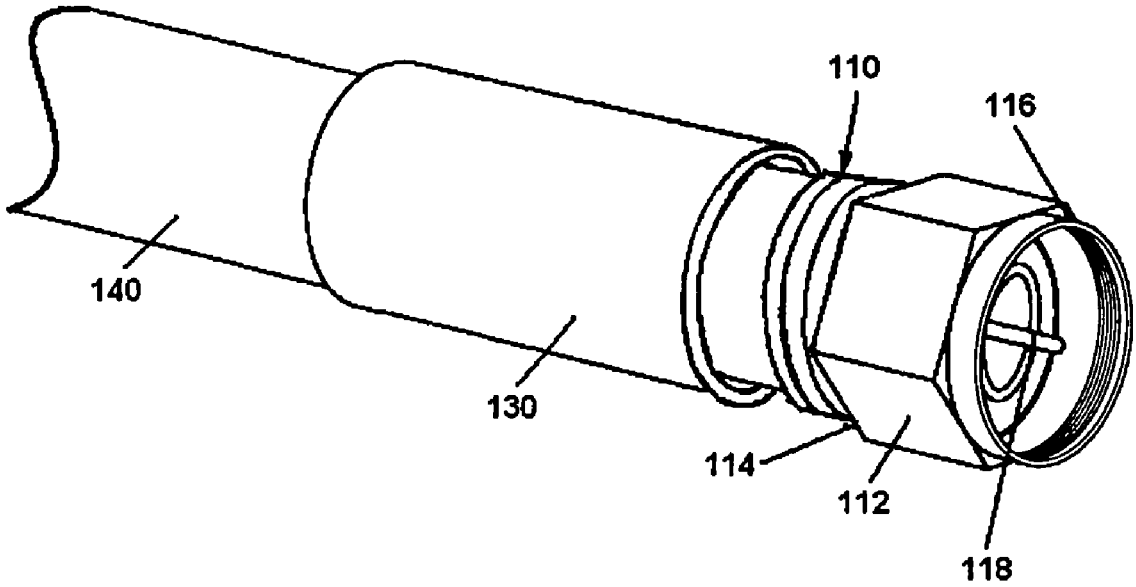
FIG. 7 is a perspective view of the cable, a tube, and a connector of the connector assembly illustrated in FIG. 1.

Referring to FIG. 7, the tube 130 is then slipped over the cable 140 near where the cable 140 will be terminated to the connector 110. The tube 130 is separately made. Preferably, the tube 130 is made by die casting wherein heated plastic is forced into a mold known as a die. The shape that the mold forms corresponds to the shape of the tube 130. After the heated plastic cools, it retains the shape of the mold. The cable 140 with the tube 130 is then terminated in the second end 114 of the connector 110. For a coaxial cable and an F connector, the coaxial cable is crimped to the second end 114 of the F connector by a crimping tool so that the conductive sheath 117 is electrically connected to the outer conductor 119.

Figure 8:
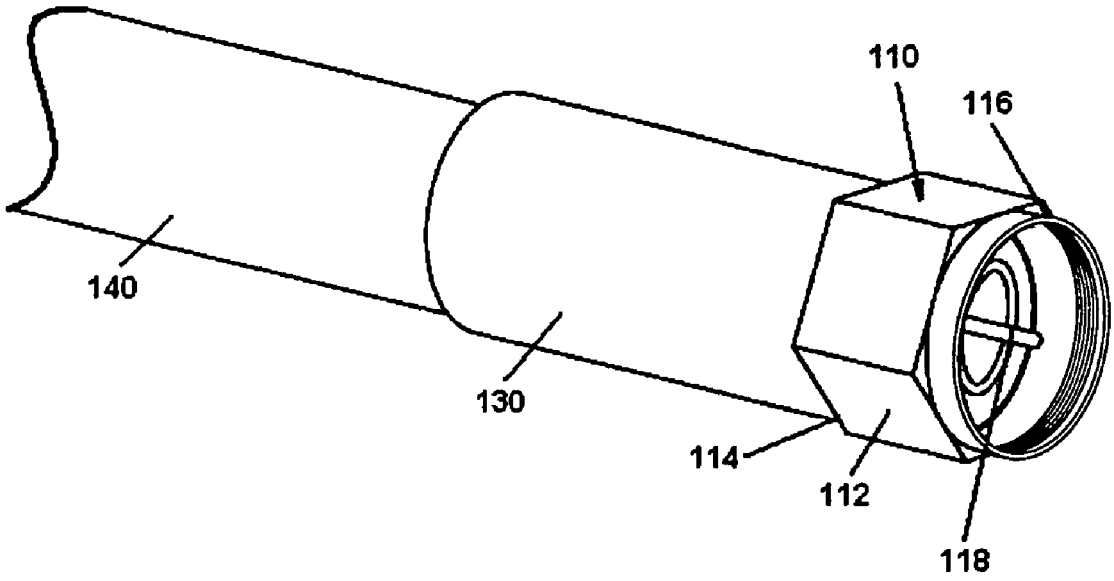
FIG. 8 is a perspective view of the cable, the tube, and the connector of the connector assembly illustrated in FIG. 1.

Referring to FIG. 8, after terminating the cable 140 to the connector 110, the tube 130 is placed over the second end 114 of the connector 110. Thereafter, the sleeve 120 can be placed over the tube 130 and the first end 112 of the connector 110. The sleeve 120 is preferably overmolded onto the tube 130 and the first end 112 of the connector 110. The overmolding is preferably done by using an overmolding die. The tube 130 and the connector 110 are placed in the overmolding die, and heated plastic is injected into the die around the tube 130 and the connector 110. After cooling, the injected plastic retains the shape of the overmolding die and forms the sleeve 120 that surrounds the tube 130 and the first end 112 of the connector 110.

Figure 9:
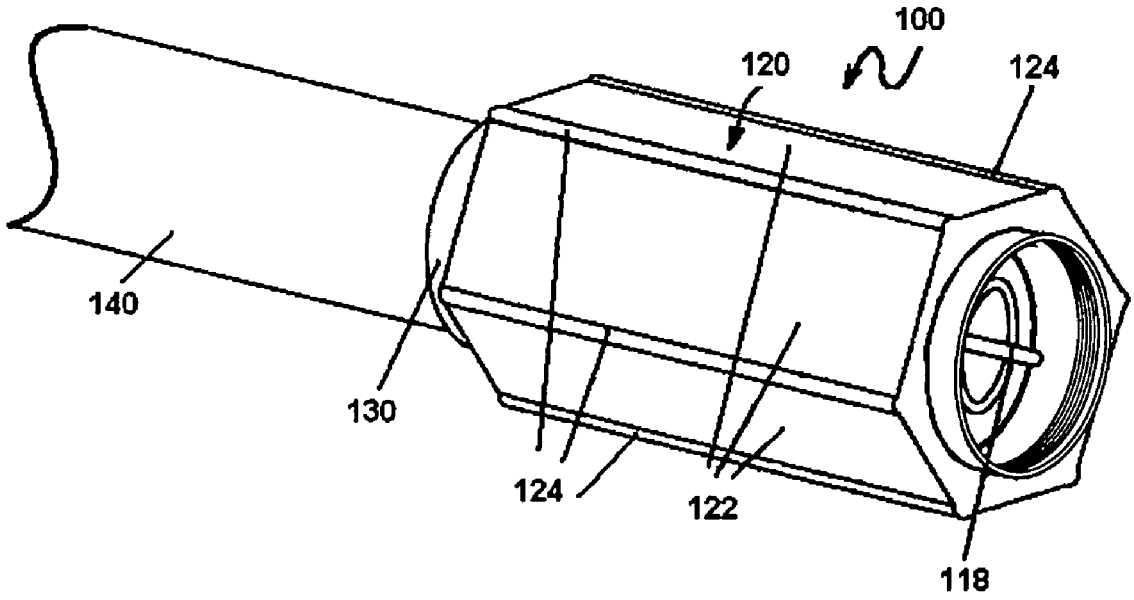
FIG. 9 is a perspective view of the connector assembly illustrated in FIG. 1.

Referring to FIG. 9, the connector assembly 100 is shown after the sleeve 120 has been placed over the tube 130 and the first end 112 of the connector 110. As described above, the sleeve 120 is fixed to the first end 112 of the connector 110. Thus, when the sleeve 120 is rotated, the first end 112 also rotates with respect to the second end 114.

While particular embodiments have been chosen to illustrate the invention, it will be understood by those skilled in the art that various changes and modifications can be made therein without departing from the scope of the invention as defined in the appended claims.

What is claimed is:

1. A connector assembly, comprising of:

an electrical connector having opposite first and second ends, said first end being rotatable with respect to said second end and configured to couple to a mating connector, said second end being configured to terminate a cable;

a tube member disposed around said second end of said electrical connector; and a sleeve molded over said first end and said tube member such that said sleeve is fixed to and does not separate from said first end, wherein when said sleeve rotates, said first end of said connector and said tube member together rotate with said sleeve, and said sleeve having an outer gripping surface.

2. The connector assembly according to claim 1, wherein said sleeve has a substantially hexagonal shape in cross-section.

3. The connector assembly according to claim 1, wherein said outer gripping surface has a plurality of longitudinal spines extending along said sleeve.

4. The connector assembly according to claim 1, wherein said sleeve is made of a material selected from the group consisting of rubber, synthetic rubber, neoprene, thermoplastic, thermosetting plastic, polyethylene, polypropylene, polystyrene, acrylonitrile butadiene styrene, polyethylene terephthalate, polyester, polyamides, polyvinyl chloride, polyurethanes, and polycarbonate.

5. The connector assembly according to claim 1, wherein when said sleeve rotates, said second end of said electrical connector does not rotate with said sleeve.

6. The connector assembly according to claim 1, wherein said tube member is made of plastic.

7. The connector assembly according to claim 1, wherein said first end of said electrical body includes a nut body.

8. The connector assembly according to claim 1, wherein said sleeve has a shape substantially corresponding to a shape of said first end.

9. The connector assembly according to claim 1, wherein said electrical connector is a co-axial connector.

10. A connector assembly, comprising of:

an electrical connector; and a gripping sleeve integral with said electrical connector such that the gripping sleeve does not separate from said electrical connector, said gripping sleeve including, an elongated body having opposite ends and a plurality of lateral surfaces disposed adjacent to each other and meeting at adjacent edges to form a substantially hexagonal shape in cross-section, a spine disposed at said adjacent edges of said lateral surfaces, said spine extending longitudinally along said adjacent edges between said ends of said elongated body, a first face and a second face at said opposite ends of the body, the first and second faces being substantially perpendicular to the lateral surfaces, a bore extending through said body from said first face to said second face, and a tube disposed in said bore and adapted to receive said electrical connector such that when the gripping sleeve rotates, the tube rotates with the gripping sleeve.

11. The gripping sleeve of claim 10, wherein said electrical connector is a co-axial connector.

12. The gripping sleeve of claim 10, wherein said gripping sleeve is molded over said electrical connector.

13. A method of forming a connector assembly, comprising the steps of:

providing an electrical connector having opposite first and second ends, the first end being rotatable with respect to the second end and configured to couple to a mating connector, the second end being configured to terminate a cable;

sliding a tube member over the second end of the electrical connector; and molding a sleeve over the first end and said tube member such that the sleeve is fixed to the first end, the sleeve having an outer gripping surface, whereby when the sleeve rotates, the first end of the electrical connector and the tube member together rotate with the sleeve.

14. The method according to claim 13, wherein when the sleeve rotates, the second end of the connector does not rotate with the sleeve.

15. The method according to claim 13, further comprising the step of:

terminating the cable at the second end of the electrical connector.

16. The method according to claim 13, further comprising the step of:

gripping the outer gripping surface of the sleeve to rotate the first end of the electrical connector.

17. The method according to claim 13, wherein the electrical connector is a co-axial connector.

* * * * *